US010242631B1

(12) United States Patent
Wang et al.

(10) Patent No.: US 10,242,631 B1
(45) Date of Patent: Mar. 26, 2019

(54) DRIVE COMPENSATION CIRCUIT AND DATA DRIVE DEVICE

(71) Applicant: SHENZHEN CHINA STAR OPTOELECTRONICS SEMICONDUCTOR DISPLAY TECHNOLOGY CO., LTD., Shenzhen (CN)

(72) Inventors: Zhenling Wang, Shenzhen (CN); Taijiun Hwang, Shenzhen (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/576,863

(22) PCT Filed: Nov. 16, 2017

(86) PCT No.: PCT/CN2017/111259

§ 371 (c)(1),
(2) Date: Nov. 27, 2017

(51) Int. Cl.
*G09G 3/00* (2006.01)
*G09G 3/36* (2006.01)

(52) U.S. Cl.
CPC ..... *G09G 3/36* (2013.01); *G09G 2310/027* (2013.01); *G09G 2310/0286* (2013.01); *G09G 2310/0289* (2013.01); *G09G 2310/0291* (2013.01); *G09G 2320/0204* (2013.01); *G09G 2370/14* (2013.01)

(58) Field of Classification Search
CPC ... G09G 2310/0289; G09G 2310/0291; G09G 3/36; G09G 2310/0286; G09G 2320/0204; G09G 2310/027; G09G 2370/14
See application file for complete search history.

(56) References Cited

U.S. PATENT DOCUMENTS

2008/0246717 A1* 10/2008 Miyake ..... G09G 3/3677 345/92
2010/0260312 A1* 10/2010 Tsai ..... G09G 3/3677 377/79

* cited by examiner

*Primary Examiner* — Muhammad N Edun
(74) *Attorney, Agent, or Firm* — JMB Davis Ben-David

(57) ABSTRACT

Provided is a drive compensation circuit including a first register unit, a second register unit, a selection unit, a voltage level shifter, a digital-to-analog conversion unit, and an amplification unit. The first register unit and the second register unit are respectively connected to the selection unit. The selection unit, the voltage level shifter, the digital-to-analog conversion unit, and the amplification unit are connected in sequence.

18 Claims, 4 Drawing Sheets

DRIVE COMPENSATION CIRCUIT AND DATA DRIVE DEVICE

CROSS-REFERENCE TO RELATED APPLICATIONS

This is the U.S. National Stage of International Patent Application No. PCT/CN2017/111259, filed Nov. 16, 2017, which in turn claims the benefit of Chinese Patent Application No. 201711009010.1, filed Oct. 25, 2017.

BACKGROUND

Field

The present disclosure relates to a technological field of liquid crystal displays, and more particularly to a drive compensation circuit and a data drive device.

Background

Please refer to FIG. 1. FIG. 1 illustrates a drive compensation circuit in the prior art. When one data drive voltage is provided for one data line, two different data voltages are required for a transistor T1 to compensate a threshold voltage Vth of the transistor T1. A frequency of a MINI LVDS of a conventional data drive chip is lower. A compensation method is to decrease a frame rate and then to provide a MINI CLK, thereby compensating the Vth of the transistor T1. However, the method cannot meet the demand for mass production.

Consequently, defects exists in the prior art and urgently need to be improved.

SUMMARY OF THE DISCLOSURE

An objective of the present disclosure is to provide a drive compensation circuit and a data drive device having a beneficial effect of effectively compensating a drive voltage of a data drive unit.

To solve the above-mentioned problem, technical schemes provided by the present disclosure are as follows.

The present disclosure provides a drive compensation circuit including a first register unit, a second register unit, a selection unit, a voltage level shifter, a digital-to-analog conversion unit, and an amplification unit.

The first register unit and the second register unit are respectively connected to the selection unit. The selection unit, the voltage level shifter, the digital-to-analog conversion unit, and the amplification unit are connected in sequence.

The first register unit is configured to acquire and store a first compensation signal.

The second register unit is configured to acquire and store a second compensation signal.

The selection unit is configured to selectively connect the first register unit or the second register unit to the voltage level shifter. The voltage level shifter processes and transmits the first compensation signal or the second compensation signal to the digital-to-analog conversion unit. The digital-to-analog conversion unit converts the processed first compensation signal or the processed second compensation signal to a corresponding analog signal. The amplification unit amplifies the analog signal with a predetermined multiple and then transmits the amplified analog signal to a data drive circuit for compensation. The amplification unit is an analog buffer amplifier. The selection unit is a switch chip.

In the drive compensation circuit of the present disclosure, the first register unit includes a first receiver, a first shift register, and a first data register. The first receiver, the first shift register, and the first data register are connected in sequence.

In the drive compensation circuit of the present disclosure, the second register unit includes a second receiver, a second shift register, and a second data register. The second receiver, the second shift register, and the second data register are connected in sequence.

In the drive compensation circuit of the present disclosure, the first receiver and the second receiver are Mini-LVDS receivers.

The drive compensation circuit of the present disclosure further includes a frame memory. The frame memory stores the first compensation signal and the second compensation signal.

In the drive compensation circuit of the present disclosure, the first data register has a first control port configured to access a first control signal STB1, the second data register has a second control port configured to access a second control signal STB2, and the selection unit has a third control port configured to access a third control signal DS.

When the third control signal DS is at a low level, the first compensation signal in the frame memory is read and stored in the first shift register. When the first control signal STB1 is at a rising edge, the first compensation signal is outputted to the first data register.

When the third control signal DS is at a high level and the first control signal STB1 is at a falling edge, the first compensation signal in the first data register is transmitted to data lines after being processed by the voltage level shifter, the digital-to-analog conversion unit, and the amplification unit.

When the second control signal STB2 is at a rising edge, the second compensation signal is stored in the second data register. When the third control signal DS is at a low level and the second control signal STB2 is at a falling edge, the second compensation is transmitted to the data lines.

The present disclosure further provides a drive compensation circuit including a first register unit, a second register unit, a selection unit, a voltage level shifter, a digital-to-analog conversion unit, and an amplification unit.

The first register unit and the second register unit are respectively connected to the selection unit. The selection unit, the voltage level shifter, the digital-to-analog conversion unit, and the amplification unit are connected in sequence.

The first register unit is configured to acquire and store a first compensation signal.

The second register unit is configured to acquire and store a second compensation signal.

The selection unit is configured to selectively connect the first register unit or the second register unit to the voltage level shifter. The voltage level shifter processes and transmits the first compensation signal or the second compensation signal to the digital-to-analog conversion unit. The digital-to-analog conversion unit converts the processed first compensation signal or the processed second compensation signal to a corresponding analog signal. The amplification unit amplifies the analog signal with a predetermined multiple and then transmits the amplified analog signal to a data drive circuit for compensation.

In the drive compensation circuit of the present disclosure, the first register unit includes a first receiver, a first shift register, and a first data register. The first receiver, the first shift register, and the first data register are connected in sequence.

In the drive compensation circuit of the present disclosure, the second register unit includes a second receiver, a second shift register, and a second data register. The second receiver, the second shift register, and the second data register are connected in sequence.

In the drive compensation circuit of the present disclosure, the first receiver and the second receiver are Mini-LVDS receivers.

The drive compensation circuit of the present disclosure further includes a frame memory. The frame memory stores the first compensation signal and the second compensation signal.

In the drive compensation circuit of the present disclosure, the first data register has a first control port configured to access a first control signal STB1, the second data register has a second control port configured to access a second control signal STB2, and the selection unit has a third control port configured to access a third control signal DS.

When the third control signal DS is at a low level, the first compensation signal in the frame memory is read and stored in the first shift register. When the first control signal STB1 is at a rising edge, the first compensation signal is outputted to the first data register.

When the third control signal DS is at a high level and the first control signal STB1 is at a falling edge, the first compensation signal in the first data register is transmitted to data lines after being processed by the voltage level shifter, the digital-to-analog conversion unit, and the amplification unit.

When the second control signal STB2 is at a rising edge, the second compensation signal is stored in the second data register. When the third control signal DS is at a low level and the second control signal STB2 is at a falling edge, the second compensation is transmitted to the data lines.

An embodiment of the present disclosure further provides a data drive device including a data drive unit and a drive compensation circuit. The data drive unit and the drive compensation circuit are connected to data lines.

The drive compensation circuit includes a first register unit, a second register unit, a selection unit, a voltage level shifter, a digital-to-analog conversion unit, and an amplification unit.

The first register unit and the second register unit are respectively connected to the selection unit. The selection unit, the voltage level shifter, the digital-to-analog conversion unit, and the amplification unit are connected in sequence.

The first register unit is configured to acquire and store a first compensation signal.

The second register unit is configured to acquire and store a second compensation signal.

The selection unit is configured to selectively connect the first register unit or the second register unit to the voltage level shifter. The voltage level shifter processes and transmits the first compensation signal or the second compensation signal to the digital-to-analog conversion unit. The digital-to-analog conversion unit converts the processed first compensation signal or the processed second compensation signal to a corresponding analog signal. The amplification unit amplifies the analog signal with a predetermined multiple and then transmits the amplified analog signal to a data drive circuit for compensation.

In the data drive device of the present disclosure, the first register unit includes a first receiver, a first shift register, and a first data register. The first receiver, the first shift register, and the first data register are connected in sequence.

In the data drive device of the present disclosure, the second register unit includes a second receiver, a second shift register, and a second data register. The second receiver, the second shift register, and the second data register are connected in sequence.

In the data drive device of the present disclosure, the first receiver and the second receiver are Mini-LVDS receivers.

The data drive device of the present disclosure further includes a frame memory. The frame memory stores the first compensation signal and the second compensation signal.

In the data drive device of the present disclosure, the first data register has a first control port configured to access a first control signal STB1, the second data register has a second control port configured to access a second control signal STB2, and the selection unit has a third control port configured to access a third control signal DS.

When the third control signal DS is at a low level, the first compensation signal in the frame memory is read and stored in the first shift register. When the first control signal STB1 is at a rising edge, the first compensation signal is outputted to the first data register.

When the third control signal DS is at a high level and the first control signal STB1 is at a falling edge, the first compensation signal in the first data register is transmitted to data lines after being processed by the voltage level shifter, the digital-to-analog conversion unit, and the amplification unit.

When the second control signal STB2 is at a rising edge, the second compensation signal is stored in the second data register. When the third control signal DS is at a low level and the second control signal STB2 is at a falling edge, the second compensation is transmitted to the data lines.

The embodiments of the present disclosure have a beneficial effect of effectively compensating a drive voltage of a data drive unit.

DETAILED DESCRIPTION OF THE PREFERRED EMBODIMENTS

Figure 1:
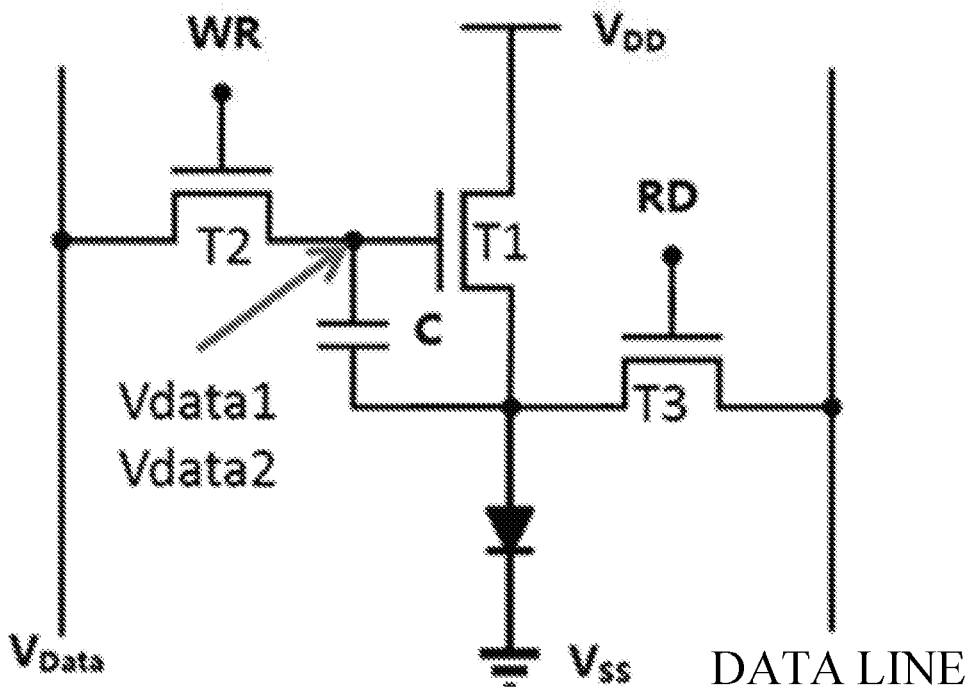
FIG. 1 (PRIOR ART)
FIG. 1 illustrates a drive compensation circuit in the prior art.

The following embodiments are referring to the accompanying drawings for exemplifying specific implementable embodiments of the present disclosure. Furthermore, directional terms described by the present disclosure, such as upper, lower, front, back, left, right, inner, outer, side, etc., are only directions by referring to the accompanying drawings, and thus the used directional terms are used to describe and understand the present disclosure, but the present disclosure is not limited thereto.

In the drawings, elements with similar structures are labeled with like reference numerals.

Figure 2:
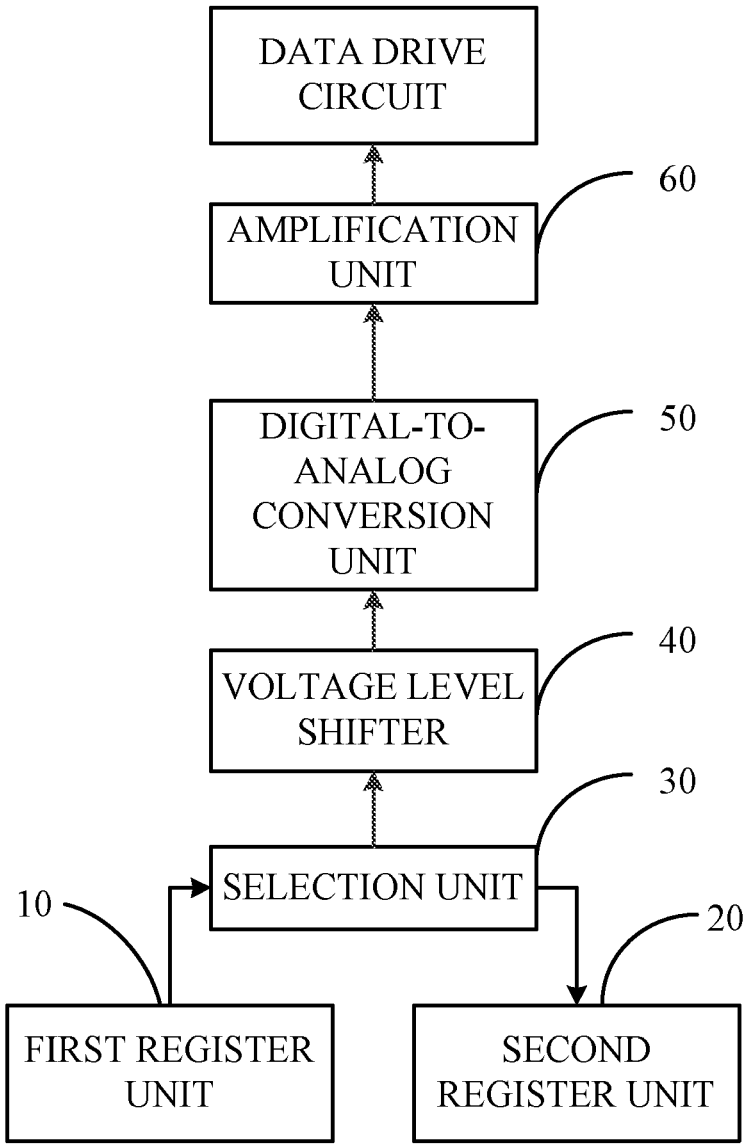
FIG. 2 illustrates a structural diagram of a drive compensation circuit in accordance with a preferred embodiment of the present disclosure.

Please refer to FIG. 2. FIG. 2 illustrates a structural diagram of a drive compensation circuit in accordance with a preferred embodiment of the present disclosure. The drive compensation circuit includes a first register unit 10, a second register unit 20, a selection unit 30, a voltage level shifter 40, a digital-to-analog conversion unit 50, and an amplification unit 60. The first register unit 20 and the second register unit 30 are respectively connected to the selection unit 30. The selection unit 30, the voltage level shifter 40, the digital-to-analog conversion unit 50, and the amplification unit 60 are connected in sequence.

The first register unit 10 is configured to acquire and store a first compensation signal.

The second register unit 20 is configured to acquire and store a second compensation signal.

The selection unit 30 is configured to selectively connect the first register unit 10 or the second register unit 20 to the voltage level shifter 40. The voltage level shifter 40 processes and transmits the first compensation signal or the second compensation signal to the digital-to-analog conversion unit 50. The digital-to-analog conversion unit 50 converts the processed first compensation signal or the processed second compensation signal to a corresponding analog signal. The amplification unit 60 amplifies the analog signal with a predetermined multiple and then transmits the amplified analog signal to a data drive circuit for compensation. The data drive circuit outputs compensated drive voltage signals to data lines.

The voltage level shifter 40 is configured to process and transmit the first compensation signal or the second compensation signal to the digital-to-analog conversion unit 50. For example, a voltage of the first compensation signal or the second compensation signal is 3.3V. The voltage level shifter 40 increases 3.3V to 5V required by the digital-to-analog conversion unit 50.

The amplification unit 60 is an analog buffer amplifier to enhance output drive ability.

The digital-to-analog conversion unit 50 is a normal miniature digital-to-analog converter.

The selection unit 30 is a switch chip.

Figure 3:
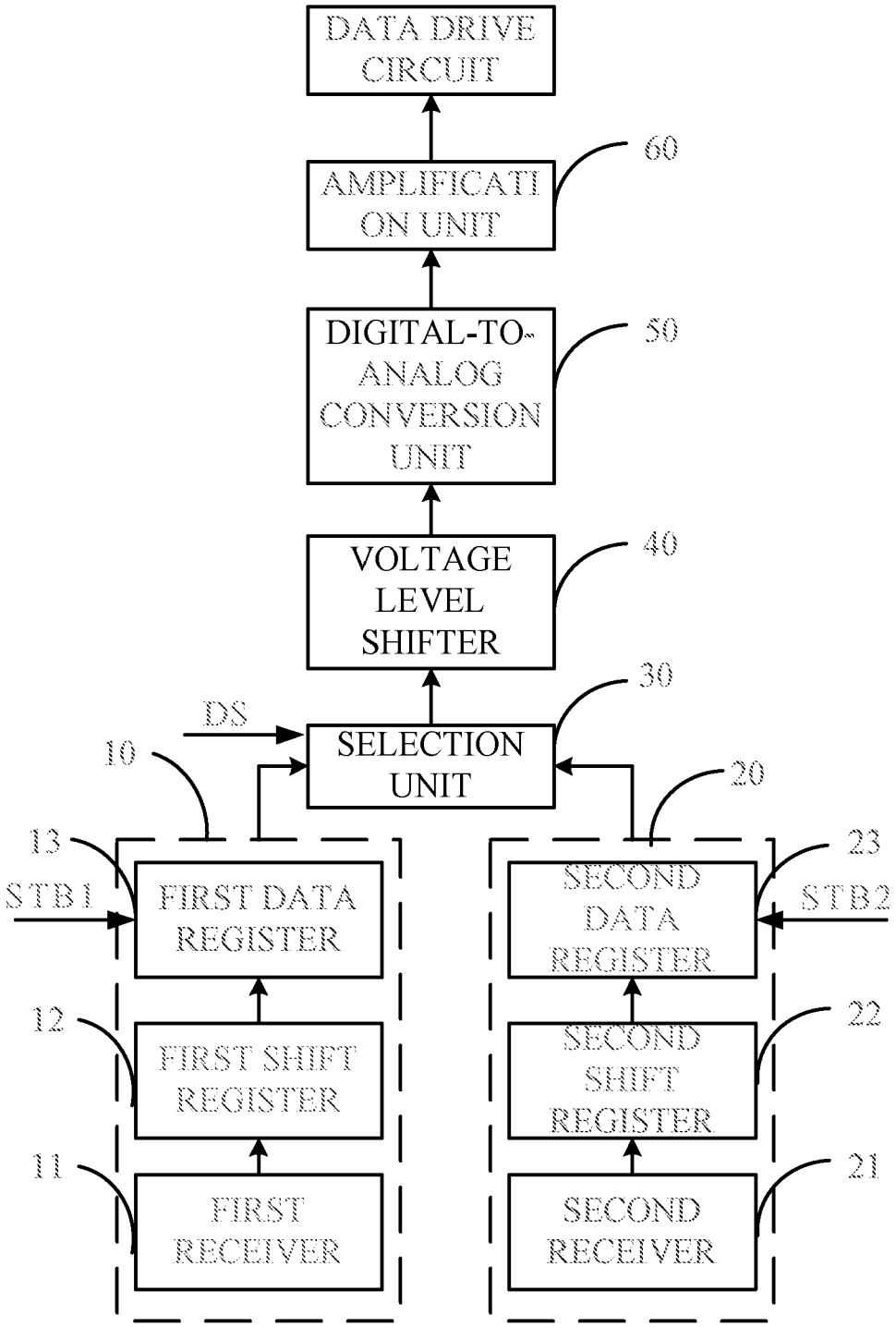
FIG. 3 illustrates a detailed circuit diagram of a drive compensation circuit in accordance with a preferred embodiment of the present disclosure.

Please refer to FIG. 3. The first register unit 10 includes a first receiver 11, a first shift register 12, and a first data register 13. The first receiver 11, the first shift register 12, and the first data register 13 are connected in sequence.

The second register unit 20 includes a second receiver 21, a second shift register 22, and a second data register 23. The second receiver 21, the second shift register 22, and the second data register 13 are connected in sequence.

The first receiver 11 and the second receiver 21 are Mini-LVDS receivers.

In some embodiments, the drive compensation circuit further includes a frame memory. The frame memory stores the first compensation signal and the second compensation signal.

Further, the first data register 13 has a first control port configured to access a first control signal STB1. The second data register 23 has a second control port configured to access a second control signal STB2. The selection unit 30 has a third control port configured to access a third control signal DS.

When the third control signal DS is at a low level, the first compensation signal in the frame memory is read and stored in the first shift register 12. When the first control signal STB1 is at a rising edge, the first compensation signal is outputted to the first data register 13.

When the third control signal DS is at a high level and the first control signal STB1 is at a falling edge, the first compensation signal in the first data register 13 is transmitted to the data lines after being processed by the voltage level shifter 40, the digital-to-analog conversion unit 50, and the amplification unit 60.

When the second control signal STB2 is at a rising edge, the second compensation signal is stored in the second data register 23. When the third control signal DS is at a low level and the second control signal STB2 is at a falling edge, the second compensation is transmitted to the data lines.

Figure 4:
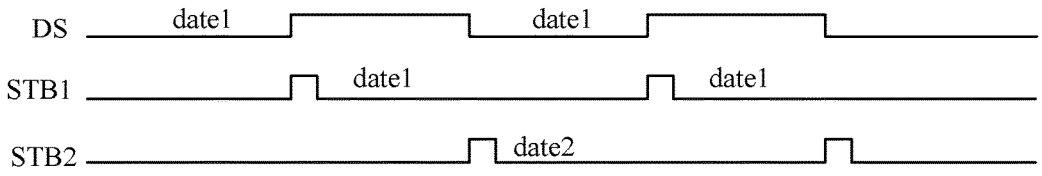
FIG. 4 illustrates a signal timing diagram in accordance with an embodiment of the present disclosure.

In the present embodiment, the first control signal STB1, the second control signal STB2, and the third control signal DS are square wave signals, and a timing diagram is shown in FIG. 4.

An embodiment of the present disclosure further provides a data drive device including a data drive unit and a drive compensation circuit. The data drive unit is electrically coupled to the drive compensation circuit. The data drive unit is electrically coupled to data lines. The drive compensation circuit is described as above.

In summary, although the present disclosure has been provided in the preferred embodiments described above, the foregoing preferred embodiments are not intended to limit the present invention. Those skilled in the art, without departing from the spirit and scope of the present invention, may make modifications and variations, so the scope of the protection of the present disclosure is defined by the claims.

What is claimed is:

1. A drive compensation circuit, comprising a first register unit, a second register unit, a selection unit, a voltage level shifter, a digital-to-analog conversion unit, and an amplification unit;

wherein the first register unit and the second register unit are respectively connected to the selection unit, and the selection unit, the voltage level shifter, the digital-to-analog conversion unit, and the amplification unit are connected in sequence;

the first register unit is configured to acquire and store a first compensation signal;

the second register unit is configured to acquire and store a second compensation signal;

the selection unit is configured to selectively connect the first register unit or the second register unit to the voltage level shifter, the voltage level shifter processes and transmits the first compensation signal or the second compensation signal to the digital-to-analog conversion unit, the digital-to-analog conversion unit converts the processed first compensation signal or the processed second compensation signal to a corresponding analog signal, and the amplification unit amplifies the analog signal with a predetermined multiple and then transmits the amplified analog signal to a data drive circuit for compensation;

the amplification unit is an analog buffer amplifier, and the selection unit is a switch chip.

2. The drive compensation circuit of claim 1, wherein the first register unit comprises a first receiver, a first shift register, and a first data register, and the first receiver, the first shift register, and the first data register are connected in sequence.

3. The drive compensation circuit of claim 2, wherein the second register unit comprises a second receiver, a second shift register, and a second data register, and the second receiver, the second shift register, and the second data register are connected in sequence.

4. The drive compensation circuit of claim 3, wherein the first receiver and the second receiver are Mini-LVDS receivers.

5. The drive compensation circuit of claim 3, further comprising a frame memory, and the frame memory storing the first compensation signal and the second compensation signal.

6. The drive compensation circuit of claim 5, wherein the first data register has a first control port configured to access a first control signal STB1, the second data register has a second control port configured to access a second control signal STB2, and the selection unit has a third control port configured to access a third control signal DS;

when the third control signal DS is at a low level, the first compensation signal in the frame memory is read and stored in the first shift register; when the first control signal STB1 is at a rising edge, the first compensation signal is outputted to the first data register;

when the third control signal DS is at a high level and the first control signal STB1 is at a falling edge, the first compensation signal in the first data register is transmitted to data lines after being processed by the voltage level shifter, the digital-to-analog conversion unit, and the amplification unit;

when the second control signal STB2 is at a rising edge, the second compensation signal is stored in the second data register; when the third control signal DS is at a low level and the second control signal STB2 is at a falling edge, the second compensation is transmitted to the data lines.

7. A drive compensation circuit, comprising a first register unit, a second register unit, a selection unit, a voltage level shifter, a digital-to-analog conversion unit, and an amplification unit;

wherein the first register unit and the second register unit are respectively connected to the selection unit, and the selection unit, the voltage level shifter, the digital-to-analog conversion unit, and the amplification unit are connected in sequence;

the first register unit is configured to acquire and store a first compensation signal;

the second register unit is configured to acquire and store a second compensation signal;

the selection unit is configured to selectively connect the first register unit or the second register unit to the voltage level shifter, the voltage level shifter processes and transmits the first compensation signal or the second compensation signal to the digital-to-analog conversion unit, the digital-to-analog conversion unit converts the processed first compensation signal or the processed second compensation signal to a corresponding analog signal, and the amplification unit amplifies the analog signal with a predetermined multiple and then transmits the amplified analog signal to a data drive circuit for compensation.

8. The drive compensation circuit of claim 7, wherein the first register unit comprises a first receiver, a first shift register, and a first data register, and the first receiver, the first shift register, and the first data register are connected in sequence.

9. The drive compensation circuit of claim 8, wherein the second register unit comprises a second receiver, a second shift register, and a second data register, and the second receiver, the second shift register, and the second data register are connected in sequence.

10. The drive compensation circuit of claim 9, wherein the first receiver and the second receiver are Mini-LVDS receivers.

11. The drive compensation circuit of claim 9, further comprising a frame memory, and the frame memory storing the first compensation signal and the second compensation signal.

12. The drive compensation circuit of claim 11, wherein the first data register has a first control port configured to access a first control signal STB1, the second data register has a second control port configured to access a second control signal STB2, and the selection unit has a third control port configured to access a third control signal DS;

when the third control signal DS is at a low level, the first compensation signal in the frame memory is read and stored in the first shift register; when the first control signal STB1 is at a rising edge, the first compensation signal is outputted to the first data register;

when the third control signal DS is at a high level and the first control signal STB1 is at a falling edge, the first compensation signal in the first data register is transmitted to data lines after being processed by the voltage level shifter, the digital-to-analog conversion unit, and the amplification unit;

when the second control signal STB2 is at a rising edge, the second compensation signal is stored in the second data register; when the third control signal DS is at a low level and the second control signal STB2 is at a falling edge, the second compensation is transmitted to the data lines.

13. A data drive device, comprising a data drive unit and a drive compensation circuit, and the data drive unit and the drive compensation circuit are connected to data lines, wherein the drive compensation circuit comprises a first register unit, a second register unit, a selection unit, a voltage level shifter, a digital-to-analog conversion unit, and an amplification unit;

the first register unit and the second register unit are respectively connected to the selection unit, and the selection unit, the voltage level shifter, the digital-to-analog conversion unit, and the amplification unit are connected in sequence;

the first register unit is configured to acquire and store a first compensation signal;

the second register unit is configured to acquire and store a second compensation signal;

the selection unit is configured to selectively connect the first register unit or the second register unit to the voltage level shifter, the voltage level shifter processes and transmits the first compensation signal or the second compensation signal to the digital-to-analog conversion unit, the digital-to-analog conversion unit converts the processed first compensation signal or the processed second compensation signal to a corresponding analog signal, and the amplification unit amplifies the analog signal with a predetermined multiple and then transmits the amplified analog signal to a data drive circuit for compensation.

14. The data drive device of claim 13, wherein the first register unit comprises a first receiver, a first shift register, and a first data register, and the first receiver, the first shift register, and the first data register are connected in sequence.

15. The data drive device of claim 14, wherein the second register unit comprises a second receiver, a second shift register, and a second data register, and the second receiver, the second shift register, and the second data register are connected in sequence.

16. The data drive device of claim 15, wherein the first receiver and the second receiver are Mini-LVDS receivers.

17. The data drive device of claim 15, further comprising a frame memory, and the frame memory storing the first compensation signal and the second compensation signal.

18. The data drive device of claim 17, wherein the first data register has a first control port configured to access a first control signal STB1, the second data register has a second control port configured to access a second control signal STB2, and the selection unit has a third control port configured to access a third control signal DS;

when the third control signal DS is at a low level, the first compensation signal in the frame memory is read and stored in the first shift register; when the first control signal STB1 is at a rising edge, the first compensation signal is outputted to the first data register;

when the third control signal DS is at a high level and the first control signal STB1 is at a falling edge, the first compensation signal in the first data register is transmitted to data lines after being processed by the voltage level shifter, the digital-to-analog conversion unit, and the amplification unit;

when the second control signal STB2 is at a rising edge, the second compensation signal is stored in the second data register; when the third control signal DS is at a low level and the second control signal STB2 is at a falling edge, the second compensation is transmitted to the data lines.

* * * * *